US005164038A

United States Patent [19]

Sundqvist

[11] Patent Number: 5,164,038

[45] Date of Patent: Nov. 17, 1992

[54] TAPE APPLICATOR

[76] Inventor: Arne Sundqvist, Solum 1186, S-870 10 Alandsbro, Sweden

[21] Appl. No.: 588,684

[22] Filed: Sep. 26, 1990

[51] Int. Cl.[5] ..... B44C 7/00

[52] U.S. Cl. ..... 156/577; 156/579; 242/75.1; 242/75.4

[58] Field of Search ..... 156/574, 579, 577, 576, 156/523; 242/75.1, 75.4, 156

[56] References Cited

U.S. PATENT DOCUMENTS 3,310,452 3/1967 Hartley et al. ..... 156/577

3,567,557 3/1971 Kingery ..... 156/523

*Primary Examiner*—David A. Simmons

*Assistant Examiner*—Robert Barker

*Attorney, Agent, or Firm*—Cohn, Powell & Hind

[57] ABSTRACT

A device for applying tape from a supply roller with an internal central hollow space upon a surface comprises a handle for carrying thereof, an arrangement for holding the supply roller rotatable, a roller being rotatably arranged for applying the tape upon the surface by rolling it on the surface by means of the handle with the tape from the tape supply roller therebetween while generating a force pulling the tape off the roller, and means for generating a rolling friction of the tape supply roller for preventing it from rotating except when a traction is applied on the tape portion leaving the roller. The device further comprises an assembly arranged to form the holding arrangement as well as the rolling friction means by having at least a spring means arranged to cause friction generating biasing of envelope surface portions of the tape supply roller against portions of a frame of the device or members connected thereto.

11 Claims, 4 Drawing Sheets

TAPE APPLICATOR

TECHNICAL FIELD OF THE INVENTION AND PRIOR ART

The present invention relates to a device for applying tape from a supply roller with an internal central hollow space upon a surface, said device comprising a handle for carrying thereof, an arrangement for holding the supply roller rotatable, a roller being rotatably arranged for applying the tape upon the surface by rolling it on the surface by means of the handle with the tape from the tape supply roller therebetween while generating a force pulling the tape off the roller, and means for generating a rolling friction of the tape supply roller for preventing it from rotating except when a traction is applied on the tape portion leaving the roller.

Such devices are generally used for sealing up or closing larger cardboard boxes within the industry, wherein said boxes may contain for instance car bumpers and the like. This type of devices may be used for sealing up or closing all types of containers in which the interconnecting power of the tape is considered to be sufficient. But it would also be possible to use a device of this kind for applying tape upon a surface so as to cover portions of the surface, to apply any type of marking and so on.

In order to enable easy handling of these devices it is of the utmost importance that the free tape portion leaving the roller in no situation comes in contact with the envelope surface of the tape supply roller, because if this happens considerable time will be spent on removing this tape end therefrom. There is a risk for this to happen when the tape supply roller spontaneously may rotate in the direction opposite to the unrolling direction. Said rolling friction generating means are arranged to prevent this from happening.

However, the solution of the problem to hold a tape supply roller rotatable and arrange a rolling friction generating means is too complicated in the device already known of the type defined in the introduction. These devices have a tape wheel rotatably arranged on frame parts of the device for receiving a tape supply roller, said tape wheel being designed to be introduced into the central hollow space of a tape supply roller and having external members for engagement with the internal wall of the hollow space so as to hold the tape supply roller. Furthermore, there are rolling friction generating means, for instance in the form of different members which brake the rotational movement of the tape wheel by bearing upon and frictionally sliding on the internal surface of the tape wheel on rotation thereof.

It is desirable to simplify the components which make it possible to hold a tape supply roller while rotating it with frictional resistance.

SUMMARY OF THE INVENTION

The object of the present invention is to provide a device of the type mentioned in the introduction, but which solve the problem of holding a tape supply roller under frictionally influenced rotation in a considerably easier way than has been done in the prior art devices discussed above.

According to the invention this object is obtained by the fact that such a device comprises an assembly arranged to form the holding arrangement as well as the rolling friction means by having at least a spring means arranged to cause friction generating biasing of the envelope surface portions of the tape supply roller against portions of a frame of the device or members connected thereto.

Thanks to the arrangement of the spring means according to the invention it is possible to completely omit a tape wheel with a rotation bearing and brake or rolling friction means belonging thereto. Said spring means in fact provides for biasing the tape supply roller against frame portions of the device or members connected thereto and thereby ensures that the tape supply roller is held in place. At the same time a rolling friction is generated by this bearing, so that the tape supply roller may rotate while sliding with its envelope surface along said frame portions or members connected thereto. This construction is considerably simpler than the constructions of the devices already known, and is thereby possible to manufacture at a lower cost. Another advantage of the device according to the invention resides in its small need of room upon storing without a tape supply roller therein, for instance for transport in larger lots, thanks to the lack of tape wheel and the voluminous members previously often existing for holding this tape wheel.

Further advantages and preferred characteristics of the invention will appear from the following description and the appended dependent claims.

BRIEF DESCRIPTION OF THE DRAWINGS

With reference to the appended drawings, below follows firstly a brief description of a prior art device and then a specific description of a preferred embodiment according to the invention.

DETAILED DESCRIPTION OF A DEVICE ACCORDING TO THE PRIOR ART

Figure 1:
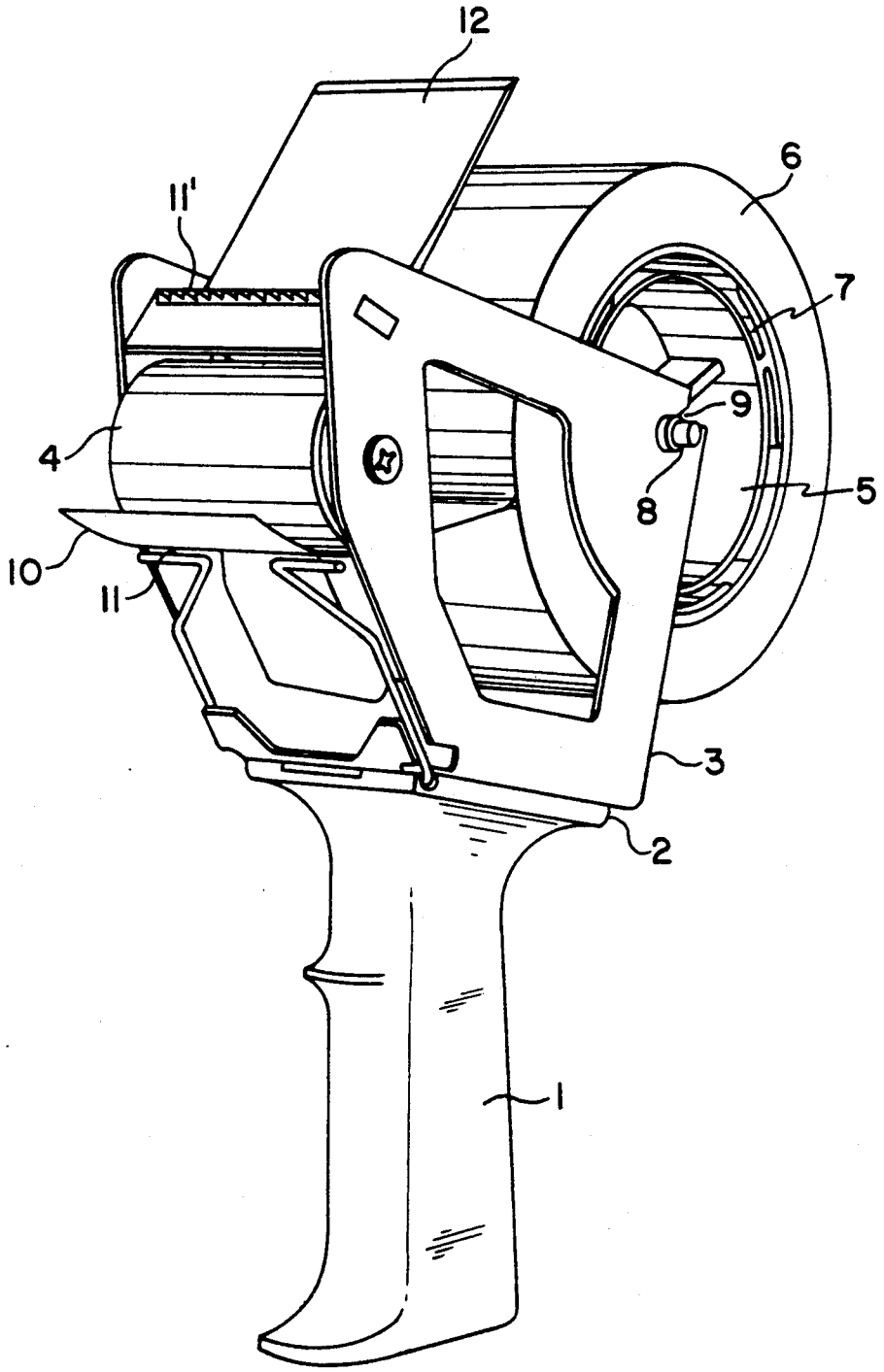
FIG. 1 illustrates a prior art device provided with a tape supply roller.

FIG. 1 shows in perspective a prior art device for applying tape upon a surface. This device has a handle 1', which at the top is terminated by a plate 2' upon which two identical gable members 3' are secured. An applying roller 4' as well as a tape wheel 5' are rotatably arranged between the gable members. The tape wheel 5' is arranged to be introduced into the internal central hollow space of a tape supply roller 6' and has external means 7' for engaging the internal wall of the tape supply roller in order to hold the latter. After the application of a tape supply roller 6' on the tape wheel 5' the latter may through its axle 8' be pushed into and be rotatably received in a suitable recess 9' in the gable member 3'. The device also has means (not shown) for generating rolling friction of the tape wheel 5', so that it does not rotate in absence of other forces except its own forces of inertia applied thereon. The free end 10' of the tape is intended to be guided by guiding means 11' to the region below the applying roller 4'. The device also comprises tearing off teeth 11'' for tearing the tape off and an after press member 12' for after pressing the tape portion torn off and applied on a surface against the latter.

In order to make room for a large full supply roller in this device, it is necessary to make the gable members 3' comparatively room demanding, so that the axle 8' of the tape wheel 5' will be at a considerable distance from the applying roller 4' and the plate 2'. Other disadvantages of this device have already been discussed in the introduction.

DETAILED DESCRIPTION OF A PREFERRED EMBODIMENT OF THE INVENTION

Figure 2:
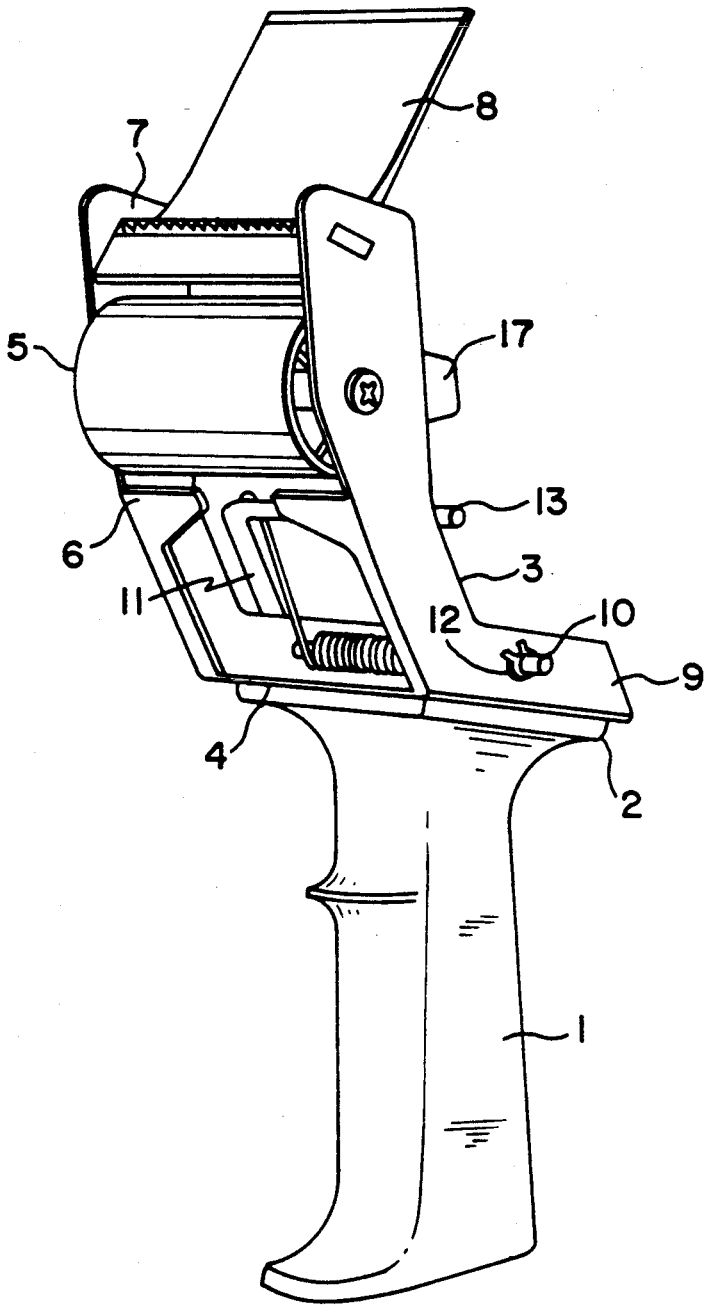
FIG. 2 is a perspective view of a device according to a preferred embodiment of the invention without tape supply roller.
Figure 3:
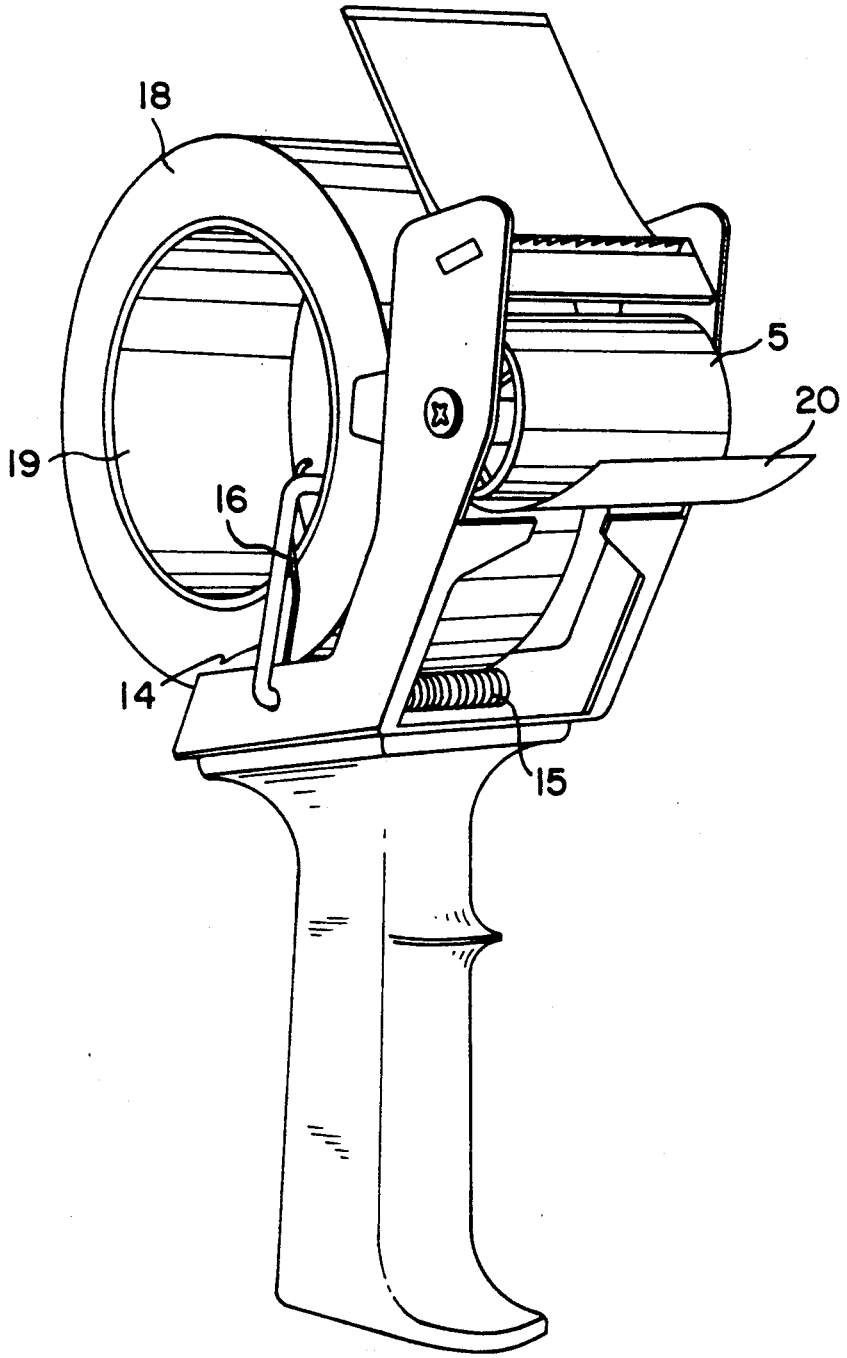
FIG. 3 is a perspective view of the device according to FIG. 2, but from another direction and provided with a tape supply roller.

In FIGS. 2 and 3 a preferred embodiment of the device according to the invention is shown in an unloaded state and in a state loaded with a tape supply roller, respectively. The device has a traditional handle 1, with an upper plate 2, onto which the rest of the device may be pushed on and secured by hooking. The device has a frame consisting of two separated gable members 3, which are rigidly interconnected by a lower base member 4 received in the plate 2. An applying roller 5 is arranged freely rotatably between the gable members 3. Tape guiding means 6 are arranged on the internal side of the gable members to guide a free tape end between themselves and the applying roller. A row of tape tearing off teeth 7 is arranged between the gable members on the other side of the applying roller. At the upper end of the gable members there is also arranged an after press member 8 of resilient material, i.e. material with a so called memory.

A second leg 10 of a substantially U-shaped loop 11 is conveyed through lower portions 9 of the gable members and rotatably held about its axis. The extremity of the leg 10 is held in place against displacements in the direction of its axis by suitable means, such as a clamp 12. The loop 11 has a first leg 13, extending substantially parallel to the second leg 10. These legs are rigidly interconnected by an arm 14. One end of a torsion spring 15 is secured with respect to the gable member associated with the free end of the second leg 10. This torsion spring is wound around and along the second leg 10 to the region of the opposite gable member and terminated there by a portion 16 prolonged from the helical windings, which portion is arranged to grasp around the first leg 13 while tending to push it in the direction of the gable member 3. Thus, the first leg 13 may upon application of force counteracting the action of the torsion spring 15 be pivoted along an arcuated path with the axis of the second leg 10 as pivot axis.

Finally, the gables have small discs 17 projecting backwardly for guiding a tape supply roller received in the device.

When the device is to be loaded with a tape supply roller 18, the first leg 13 is moved in the clockwise direction, as seen in FIG. 2, so that a tape supply roller may be drawn on this without hitting the discs 17. Releasing the first leg 13 results in that the torsion spring 15 by means of the prolonged spring portion 16 presses the first leg 13 into bearing against the internal walls 19 of the internal hollow space of the tape supply roller 18, so that envelope surface portions of the tape supply roller 18 are pressed into bearing against on one hand the helical windings of the spring and on the other the applying roller 5. Thanks to the friction established at these two bearing points of the envelope surface of the tape supply roller, the tape supply roller may not rotate in either direction solely as a consequence of its own gravitation and forces of inertia. Thus, thanks to this friction, the free tape end may not retreat, which would require a reloading of the tape supply roller. Furthermore, the friction always makes the free tape portion to be stretched on applying it on the surface, so that this application may be carried out with a tape being stretched and thereby well adhering to the surface.

The torsion spring 15 will, during the further progress of the application of a tape deriving from the tape supply roller, cause a displacement of the first leg 13 of the U-shaped loop in the clockwise direction as seen in FIG. 3. Accordingly, the rolling friction against the applying roller 4 and the helical windings of the torsion spring 15 will be present permanently. Thus, the U-shaped loop with the torsion spring 15 functionally replaces the tape wheel and the axle and brakes belonging thereto in the device according to prior art. This makes it possible to reduce the dimensions of the gable members considerably. The loading of the device with a tape supply roller and the removal of an empty one from the device may be carried out in a considerably easier and more rapid way than previously by just pivoting the first leg 13 of the loop about the pivot axis formed by its second leg and moving the tape supply roller in question in the direction of the extension of the first leg 13.

Figure 4:
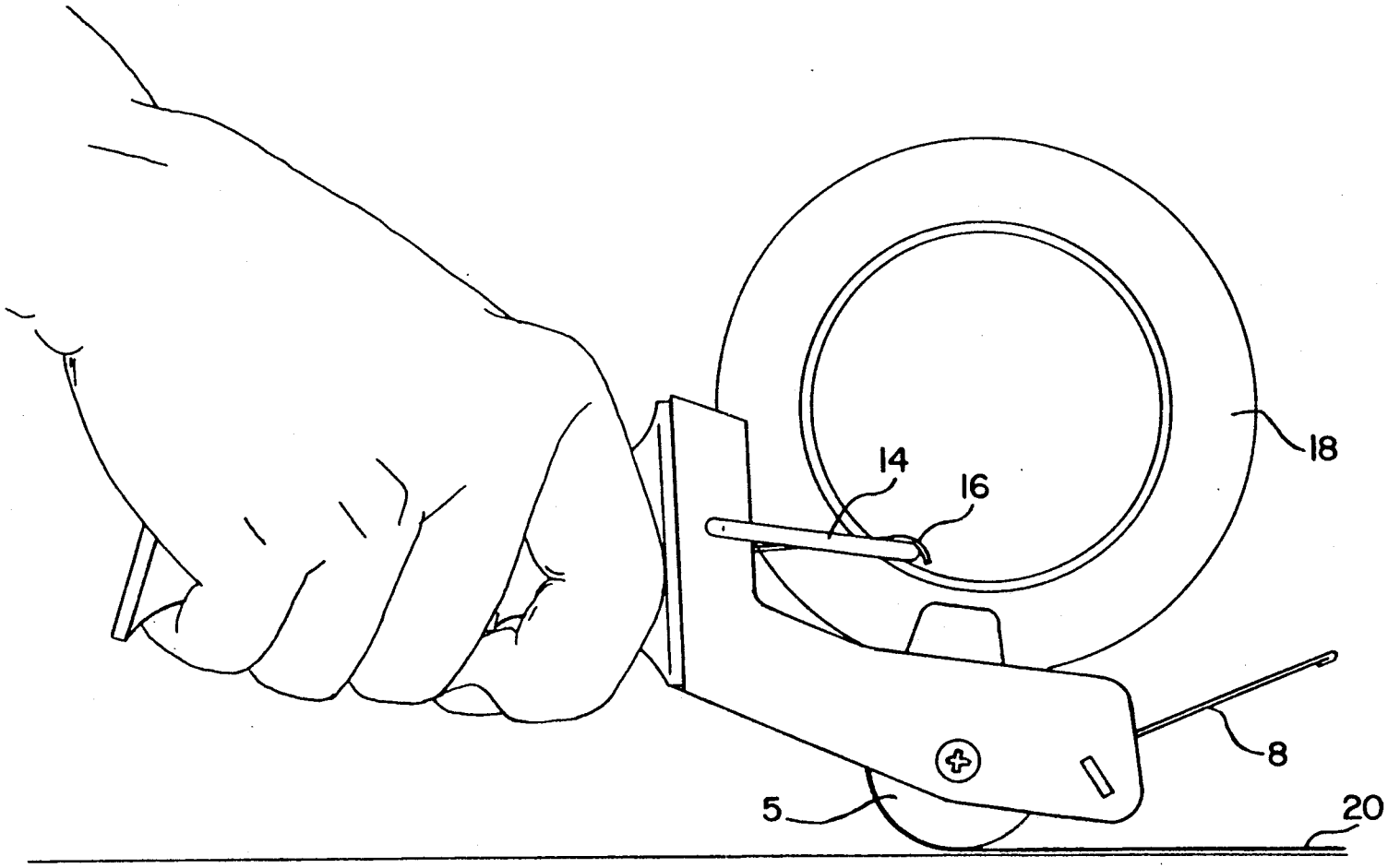
FIG. 4 is a side elevational view illustrating the application of tape on a surface by means of the device according to FIGS. 2 and 3.

FIG. 4 illustrates how a device according to the invention is used to apply tape on a surface. Initially, i.e. in connection with the loading of the device, a tape portion 20 is drawn from the envelope surface of the tape supply roller and conveyed between the tape guiding means 6 and the applying roller 5. In the moment of application this tape portion 20 is brought into bearing against the surface onto which the tape is going to be applied, and the applying roller 5 is subsequently pressed against this tape portion 20 and the device is drawn away from the tape end while rolling the applying roller on the surface with the tape therebetween, the applying roller and the adherence of the tape to the surface generating a force drawing the tape portion leaving the tape supply roller off the latter, so that the tape supply roller rotates about its axis and delivers tape. This rotation is constantly carried out during friction generation thanks to the torsion spring biasing the first leg 13 into bearing against the internal wall of the tape supply roller and thereby the envelope surface of the tape supply roller into bearing against portions of the envelope surface of the applying roller and the helical windings of the torsion spring. When a desired length of tape has been applied on the surface the device is pivoted in the clockwise direction as seen in FIG. 4, so that the tape tearing off teeth 7 enter into contact with and tear the tape off. By drawing the after press member 8 over the end portion of the tape length this is brought to adhere uniformly and completely to the surface. Then the device will be ready for immediate applying of a new tape length in another spot.

The invention enables the achievement of a device with a very compact design and this may be stored even more compactly by the possibility of rapid separation of the handle from the frame.

The invention is of course not restricted to the preferred embodiment described above, but several possibilities of modification will be apparent to a man skilled in the art to which the invention pertains, without departing from the basic idea of the invention.

It would for instance be possible to make the first leg mentioned above affected by a spring arranged on any of the gable members, perhaps of another type than the torsion spring, for instance a compression spring. The second leg of the loop may in such a case be omitted and the arm may be pivotally connected to a gable member. But it would also be possible to arrange the leg 13 to carry out a translational movement in a rectilinear path while influenced by a spring. The principal thing is that the first leg by means of said spring, which for the rest may be more than one, is permanently pressed into bearing against the internal wall of the internal hollow space of a tape supply roller and by that presses envelope surface portions of the tape supply roller against portions of the frame of the device or members connected thereto for generation of rolling friction. Thus, in the embodiment shown the members connected to the frame consist of the helical windings of the torsion spring and envelope surface portions of the applying roller. The frame could of course be provided with particular support surfaces arranged solely for frictional bearing against the envelope surface of the tape supply roller. These support surfaces could be provided with a material with an appropriate friction coefficient with respect to the rear side of the tape in question. A rotatable wheel or cylinder could naturally be arranged on the leg 13 and be arranged to enter into contact with the wall of the internal hollow space of the tape supply roller.

Finally, the first leg could have a deflected portion at its outer free end, which would replace the lateral guiding discs.

I claim:

1. A device for applying tape from a supply roller with an internal central hollow space upon a surface, said device comprising a handle for carrying thereof, an arrangement for holding the supply roller rotatable, a roller being rotatably arranged for applying the tape upon the surface by rolling it on the surface by means of the handle with the tape from the tape supply roller therebetween while generating a force pulling the tape off the roller, and means for generating a rolling friction of the tape supply roller for preventing it from rotating except when a traction is applied on the tape portion leaving the roller, wherein the device further comprises an assembly arranged to form the holding arrangement as well as the rolling friction means by having at least a spring means arranged to cause friction generating biasing of envelope surface portions of the tape supply roller against portions of a frame of the device or members connected thereto, said assembly comprising a first projection protruding into the internal hollow space of the supply roller and being pivotally arranged so that the projection is moveable along an arcuated path inside the hollow space of the supply roller, said spring means being arranged to urge the projection in this path to biasing bearing against the internal wall of said hollow space for friction generating biasing of the envelope surface of the supply roller against the frame of the device or members connected thereto.

2. A device for applying tape from a supply roller with an internal central hollow space upon a surface, said device comprising a handle for carrying thereof, an arrangement for holding the supply roller rotatable, a roller being rotatably arranged for applying the tape upon the surface by rolling it on the surface by means of the handle with the tape from the tape supply roller therebetween while generating a force pulling the tape off the roller, and means for generating a rolling friction of the tape supply roller for preventing it from rotating except when a traction is applied on the tape portion leaving the roller, wherein the device further comprises an assembly arranged to form the holding arrangement as well as the rolling friction means by having at least a spring means arranged to cause friction generating biasing of envelope surface portions of the tape supply roller against portions of a frame of the device or members connected thereto, said assembly comprising a first projection being substantially parallel to the axis of the tape supply roller and protruding into the internal hollow space of the supply roller and an arm, one end of which is rigidly connected to said projection, the other end of said arm being pivotally arranged about an axis being substantially parallel to said axis of the supply roller and located eccentrically thereto, so that the projection is moveable along an arcuated path inside the hollow space of the supply roller, said spring means being arranged to urge the projection in this path to biasing bearing against the internal wall of said hollow space for friction generating biasing of the envelope surface of the supply roller against the frame of the device or members connected thereto.

3. A device as defined in claim 2, wherein the assembly has a substantially U-shaped loop, a first leg of which consists of said projection and a second leg consists of a second projection pivotally arranged with respect to the frame about an axis being substantially parallel to said axis of the supply roller, a base of the U consisting of said arm.

4. A device as defined in claim 2, wherein the spring means is a torsion spring adapted to act between the frame of the device and said first projection so as to pivot the latter along said path into biasing bearing against the internal wall of the hollow space in a tape supply roller inserted in the device.

5. A device as defined in claim 4, wherein one end of the torsion spring is secured with respect to the frame of the device, said torsion spring being from this end helically wound around and along the extension of the second projection, said spring being at its other end terminated by a portion prolonged from the helical winding of the spring and being arranged to grasp around the first projection while tending to press this into bearing against a tape supply roller arranged in the device.

6. A device as defined in claim 5, wherein the torsion spring is secured with respect to the frame of the device close to the free end of the second projection, said portion prolonged from the helical windings of the torsion spring being located close to the arm interconnecting the two legs of the U-shaped loop.

7. A device as defined in claim 1, wherein the spring means is arranged to press a portion of the envelope surface of the tape supply roller received in the device against the envelope surface of said applying roller.

8. A device as defined in claim 5, wherein the helical windings of the torsion spring are arranged so as together with the envelope surface of the applying roller form the only supports for the envelope surface of a tape supply roller received in the device.

9. A device as defined in claim 2, wherein a tape supply roller received in the device is held against displacement out of the device in a direction substantially parallel to the axis of the tape supply roller only by means of one or several lateral guiding means and the bearing friction of the first projection with respect to the internal wall of the tape supply roller, so that an empty tape supply roller may be removed only by pressing the first projection backwards in its travelling path and lifting the roller away past the lateral guiding means.

10. A device as defined in claim 3, wherein the spring means is a torsion spring and one end of the torsion spring is secured with respect to the frame of the device, said torsion spring being from this end helically wound around and along the extension of the second projection, said spring being at its other end terminated by a portion prolonged from the helical winding of the spring and being arranged to grasp around the first projection while tending to press this into bearing against a tape supply roller arranged in the device.

11. A device as defined in claim 7, wherein the spring means is a torsion spring and the helical windings of the torsion spring are arranged so as together with the envelope surface of the applying roller form the only supports for the envelope surface of a tape supply roller received in the device.

* * * * *